United States Patent [19]

Zandman

[11] 4,455,744

[45] Jun. 26, 1984

[54] METHOD OF MAKING A PRECISION RESISTOR WITH IMPROVED TEMPERATURE CHARACTERISTICS

[75] Inventor: Felix Zandman, Philadelphia, Pa.

[73] Assignee: Vishay Intertechnology, Inc., Malvern, Pa.

[21] Appl. No.: 353,437

[22] Filed: Mar. 1, 1982

Related U.S. Application Data

[62] Division of Ser. No. 072,003, Sep. 4, 1979, Pat. No. 4,318,072.

[51] Int. Cl.[3] ..... H01C 17/00

[52] U.S. Cl. ..... 29/610 R; 29/593; 29/620

[58] Field of Search ..... 29/610 R, 620, 593; 427/101, 386; 338/3, 7, 8, 306, 307, 308, 314, 195

[56] References Cited

U.S. PATENT DOCUMENTS 3,517,436 6/1970 Zandman et al. ..... 29/620

3,934,058 1/1976 Seebacher ..... 29/610 R 4,104,607 8/1978 Jones ..... 29/621

4,322,456 3/1982 Martin ..... 427/386

*Primary Examiner*—Carl E. Hall

*Assistant Examiner*—P. W. Echols

*Attorney, Agent, or Firm*—Weiser, Stapler & Kimmelman

[57] ABSTRACT

A precision resistor using a resistance metal film etched into a long serpentine strip cemented to a substrate. This substrate is a composite of rigid materials and plastics. The composite thermal coefficient of expansion of the substrate is given a non-linearity which in turn induces a stress related non-linear resistance change in the cemented film when the temperature changes. This stress-induced non-linear change is of approximately the same shape as the inherent non-linearity of the resistance versus temperature of the metal film, but opposite in polarity, over a wide range of resistor operating temperatures. Over the range, a much closer approximation to complete temperature compensation is obtained than previously.

10 Claims, 10 Drawing Figures

FIG. 1
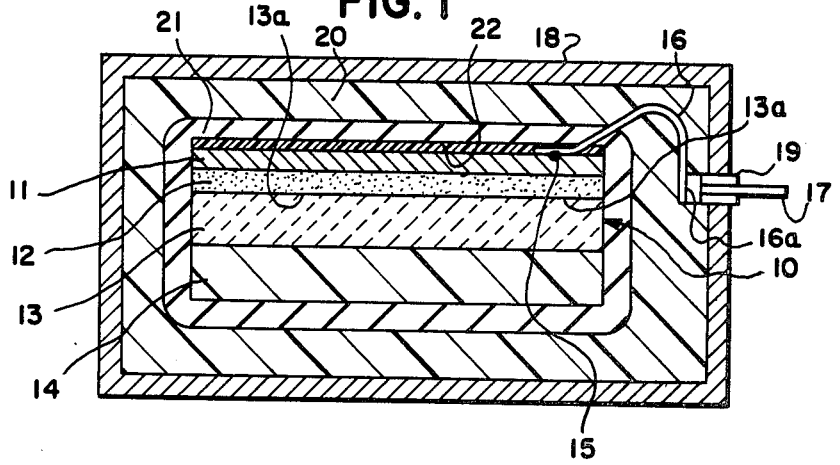
FIG. 3
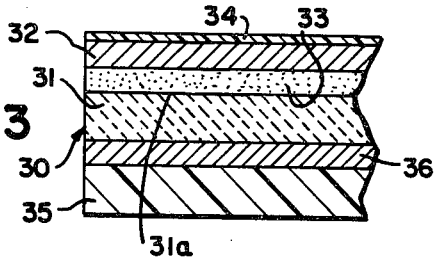
FIG. 4a
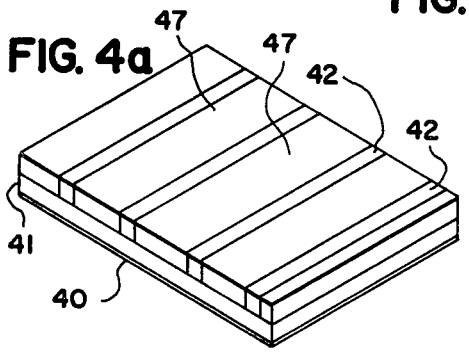
FIG. 4b
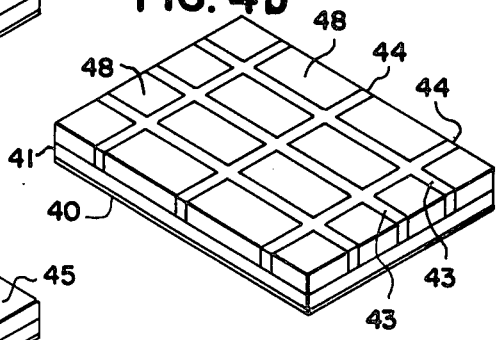
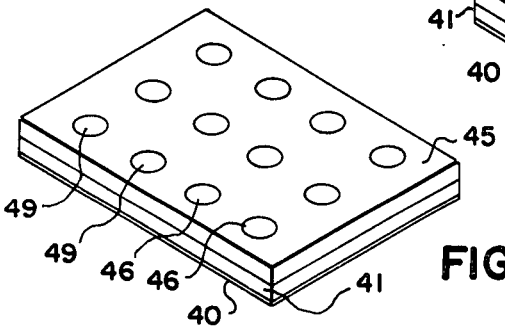
FIG. 4c FIG. 2a
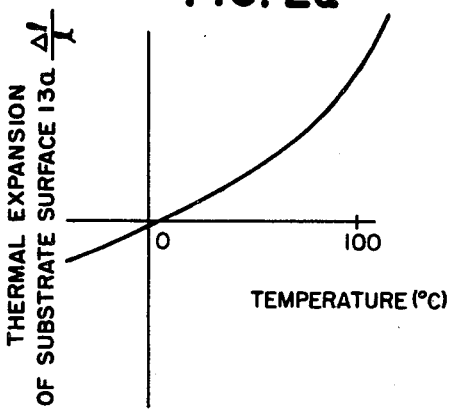
FIG. 2b
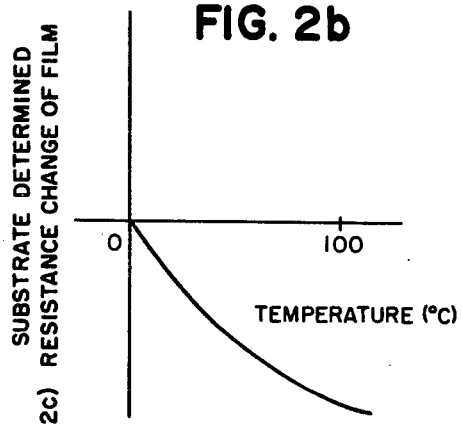
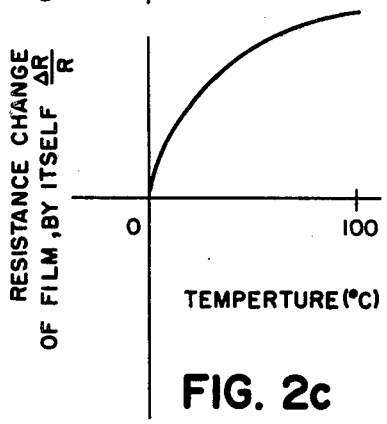
FIG. 2c
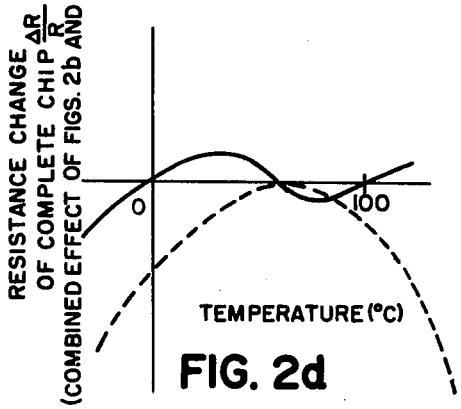
FIG. 2d
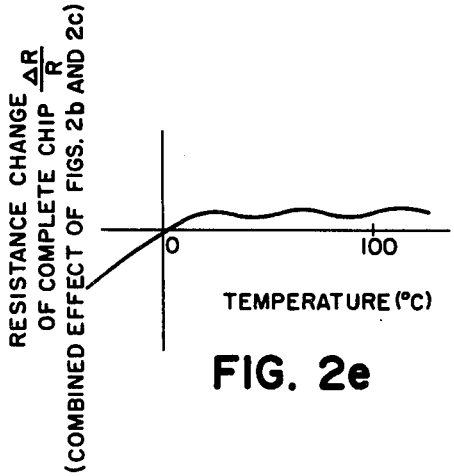
FIG. 2e

METHOD OF MAKING A PRECISION RESISTOR WITH IMPROVED TEMPERATURE CHARACTERISTICS

This is a division of application Ser. No. 072,003 filed Sept. 4, 1979 now U.S. Pat. No. 4,318,072.

The present invention relates to electrical components, and particularly to resistors. It relates more especially to high-precision resistors of the type utilizing a metal film of resistive material, etched to form an elongated, serpentine strip supported by a substrate.

This type of resistor is described, for example, in U.S. Pat. Nos. 3,405,381 and 3,517,436, both of which name the present inventor as one of the patentees, and both of which are assigned to the same assignee as the present invention.

One of the characteristics which it is frequently desired to impart to precision resistors of this general type is that they shall have as low a temperature coefficient of resistance as possible. One approach to this objective—which, incidentally, is also disclosed by reference to certain illustrative examples in the above-mentioned two U.S. Patents—involves making an appropriate selection of the metal film, the substrate, and the material which attaches (cements) the film to the substrate.

More particularly, it is known to use for example a nickel chromium metal film in which the desired serpentine path is formed. This film, before being cemented to the substrate, has an "inherent" temperature coefficient of resistance of, say, 20 parts per million per degree Centigrade (ppm/°C.) at a given temperature value. Moreover, the stress versus resistance change characteristic of the metal film, which is given by the expression $$\text{Stress} = \frac{E}{K} \cdot \frac{\Delta R}{R}$$

where

E is the modulus of elasticity of the film,

K is a constant,

R is the initial resistance value, and

ΔR is the resistance change is such that K is, say, approximately equal to +2.

This metal film is cemented firmly to the substrate so that stress is transmitted between metal film and substrate substantially without creep. The substrate itself is made of such material, e.g. glass or ceramic, that the difference between its temperature coefficient of expansion ($\alpha_s$) and that of the metal film ($\alpha_f$) is, say, substantially equal to 10 ppm/°C. For example, $\alpha_f$ may be 16 ppm/°C. and $\alpha_s$ may be 6 ppm/°C., yielding a difference ($\alpha_f - \alpha_s$) equal to 10 ppm/°C. Herein, $\alpha$ is defined as $\Delta l/l$ per °C., and $\Delta l/l$ is the relative expansion or contraction.

As a result, temperature variations would produce stress-induced resistance changes in the metal film corresponding to $2\times10$, or 20 ppm/°C. ($20\times10^{-6}$ Ohms per Ohm per degree centigrade). However, it will be recognized that these stress-induced resistance changes must be of opposite sense to those due to the temperature coefficient of the metal film itself. In this case the substrate has a lower coefficient of thermal expansion than the metal film and hence the metal film is chosen here to have a positive temperature coefficient of resistance. Therefore, a given change in temperature produces a change in film resistivity which gives a resistance change in one sense (positive), whereas the corresponding change in substrate-induced stress gives a resistance change in the opposite sense (negative).

By making these opposing phenomena essentially equal, there is achieved a substantial reduction in temperature sensitivity of the precision resistor.

Although the known technique described above has been remarkably successful, this is not to say that still further improvement is not possible. In particular, it will be recognized that a precision resistor which has practically no temperature sensitivity can be produced by the foregoing technique only right at, or in the near vicinity of a given temperature value.

That is because the temperature coefficient of resistance of the metal film itself varies as a non-linear function of temperature, whereas the difference between the coefficients of thermal expansion of substrate and film (which is what creates the stress-induced, opposing changes) varies as a substantially linear function of temperature. As a result, except in a relatively narrow range of temperatures around the optimum value, the resistor will be sensitive to temperature variations.

It is therefore an object of the present invention to provide an improved precision resistor of the metal film-cemented to-substrate type under discussion.

It is another object to provide such a resistor which exhibits reduced temperature sensitivity over a wider range of temperatures than heretofore.

It is still another object to provide such a precision resistor which has practically zero temperature coefficient at more than one value of temperature.

It is still another object to provide a method of manufacturing such an improved resistor.

These and other objects which will appear are achieved in accordance with the present invention by utilizing for the substrate of the precision resistor, not a single slab of material, such as the ceramic, or glass, or metal heretofore used, but a composite "layered" structure. This composite structure has one of its portions, or layers, made of a very rigid material, e.g. the conventional ceramic, while having the other portion, or layer, made of a plastic material such as epoxy, for example. The plastic and ceramic are firmly attached by cementing them together so that when subject to differential stress during temperature changes, there is no creep between them. These ceramic and plastic materials are so chosen, with respect to inherent temperature-dependent expansion characteristics, geometrical characteristics (thickness and surface size), modulus of elasticity, and Poisson's ratio, that the surface of the rigid (ceramic) layer facing away from the epoxy layer exhibits a non-linear variation in dimensions as a function of temperature.

The metal film which constitutes the resistive material of the precision resistor is cemented to the above-mentioned ceramic surface facing away from the epoxy layer.

Because plastics exhibit visco-elastic (time dependent creep) characteristics, it was suspected that the resistor will perform well only around room temperature. Surprisingly, the non-linear temperature coefficient of resistance characteristic previously noted for the metal film itself is apparently susceptible of being significantly counteracted by the resistance change created by the now also non-linear temperature coefficient of expansion of the adjacent ceramic surface, as imparted to that surface by the composite ceramic-plus-plastic structure. This results in a temperature coefficient of resistance which is much lower over a wide temperature range and not only around room temperature.

In practice, it will be necessary for the plastic (e.g. epoxy) portion of the composite structure to have a thickness which is of the same order of magnitude as the rigid (e.g. ceramic) portion. For example, each of these may be about 20 mils thick, while the resistive metal film may have a conventional thickness of about 0.03 to 0.20 mils.

For further details, reference is made to the discussion which follows, in light of the accompanying drawings, wherein FIG. 1 is a diagrammatic illustration in cross-section of an embodiment of the present invention;

FIGS. *2a, 2b, 2c, 2d* and *2e* are graphs which illustrate various phenomena involved in the practice of the present invention;

FIG. 3 is a diagrammatic fragmentary view of another embodiment of this invention; and FIGS. *4a, 4b* and *4c* are diagrammatic illustrations of still other such embodiments.

The dimensions of the various figures are not to the same scale, nor are the individual elements in any given figure to the same scale. The same reference numerals are used to denote similar elements in different ones of the figures.

Referring to FIG. 1, this shows, in greatly enlarged form, a diagrammatic cross-section through a precision resistor embodying the present invention.

The basic resistor unit 10 (sometimes called "chip") includes the metal film 11 firmly attached by a cement layer 12 to ceramic substrate portion 13. In addition, in accordance with the present invention, there is an epoxy substrate portion 14 which is firmly attached to ceramic layer 13. This can be done by cementing or casting or other deposition methods. It will be understood that metal film 11 has the desired resistive pattern formed therein prior to or after cementing it to the substrate.

Electrical connection to chip 10 is made by leads, of which one lead 16 is visible in FIG. 1, spot welded or soldered at one end 15 to metal film 11. The other end of lead 16 is connected to terminal pin 17 through a junction 16*a*. Lead 17 extends through outer metal case 18 via insulating bushing 19. Thermal bonding or ultrasonic bonding can also be used at junctions 15 and/or 16*a*. To facilitate this, the metal film is plated with gold or other alloy in the area of the junctions.

Prior to or after insertion into the case 18, the chip is enrobed in a very flexible (e.g. soft silicon rubber) cushion 21. The space 20 between cushion 21 and case 18 is filled with epoxy.

Alternatively, the soft rubber cushion 21 may substantially fill the interior of case 18, or the chip may be suspended within the case 18 by its connecting leads, which would then have to be strong and rigid, and surrounded by air, gas, a vacuum, or oil within case 18.

A thin epoxy protective and sealing layer 22 may also be present directly on metal film 11.

Turning now to FIGS. *2a* through *2e*, these show graphs of various relationships which will be helpful in explaining the present invention. In all four of these Figures, the abscissa represents temperature, e.g. a range of temperatures including that from 0° C. to 100° C. In FIG. *2a*, the ordinate represents values of thermal expansion at the surface 13*a* of ceramic portion 13 in FIG. 1 which faces away from epoxy portion 14. The graph in FIG. *2a* shows the variation of the thermal expansion $\Delta l/l$ of the surface 13*a* of the substrate as a function of temperature. Note particularly that this is a non-linear relationship, even though the variation in thermal expansion $\Delta l/l$ of the ceramic alone and the film, by itself (not bonded), would be nearly linear.

FIG. *2b* shows the corresponding change in resistance of metal film 11 (FIG. 1), attributable to the thermally induced stress arising from the difference between the coefficients of thermal expansion of the substrate and the film ($\alpha_s - \alpha_f$). This relationship is also non-linear because $\alpha_s$ is non-linear.

FIG. *2c* shows the variation with temperature of the resistance $\Delta R/R$ of the metal film 11, itself, as it would be if unaffected by being cemented to the composite ceramic-plus-epoxy substrate of FIG. 1. This relationship of FIG. *2c* is seen to be similar to FIG. *2b* in its general shape, but of opposite polarity.

The resulting overall effect is then represented in FIGS. *2d* (solid line) or *2e*, where the influences represented in FIGS. *2b* and *2c* are seen to approximately cancel out. This leaves the chip 10 with a resistance variation as a function of temperature which is comparatively small, and which remains small over the entire temperature range under consideration.

Please note that the curves shown in FIGS. *2a* through *2e* represent generalized relationships typifying embodiments of the present invention. These curves do not purport to represent precise curve shapes, or specific measured values.

The sinusoidally fluctuating shapes of the curves in FIGS. *2d* (solid line) and *2e* are indicative of the fact that perfect compensation at all temperatures may not be practically attainable, even with the present invention. This is because the temperature dependence of the resistive metal film itself may not have exactly the same (although opposite polarity) shape as that of the composite substrate. For example, the curvature of one may be given approximately by the expression $y=ax^2+b$, and the curvature of the other by $y=cx^3+dx^2+ex+f$. Superposition of these would produce a curve as shown in FIG. *2d*. However, as shown in FIG. *2e*, the resistance change may also be essentially zero over a very substantial temperature range; the result depends mainly on the specific shape of the curves in FIGS. *2b* and *2c*.

By proper choice of different materials and their thicknesses, various specific shapes of resistance-versus-temperature curves can be obtained. However, in any event these will represent such a striking reduction in variation of resistance with temperature, compared with prior resistors, that the result is a remarkable advance in precision resistor technology.

For contrast with the present invention, there is also shown in FIG. *2d*, by means of a broken line, the type of resistance change-versus temperature which prevails in the invention of U.S. Pat. Nos. 3,405,381 and3,517,436. Note that FIGS. *2d* (solid line) and *2e* show a much better temperature coefficient of resistance than FIG. *2d* (broken line).

It will also be understood that the present invention essentially linearizes the variation of chip resistance with temperature, i.e. the chip (and resistor) T. C. However, this linearized T. C. need not necessarily parallel the abscissa, as shown in the graphs of FIGS. *2d* and *2e*. Rather it may be made inclined, but still generally linear, by appropriate choice of the characteristics of the substrate characteristics.

At this point, it is believed to be appropriate to again refer briefly to the two U.S. Pat. Nos. 3,405,381 and 3,517,436 which are mentioned previously in this Specification. The reason for doing so is the following.

In these prior patents, there is disclosed a precision resistor construction utilizing a metal film patterned in the same general manner as the present invention and cemented to a substrate. In addition, in these prior patents, there is also disclosed the use of two epoxy layers, one on top of the patterned metal film and the other on the face of the substrate which fronts away from that metal film. At first blush, there might appear to be some similarity between these two prior U.S. patents and the present invention, which also includes an epoxy film on the metal film, and epoxy again on the face of the ceramic substrate portion facing away from that film. For example, in the embodiment of FIG. 1 of the present application the former is constituted by layer 22 and the latter by layer 14.

However, there is an essential difference which completely negates any such superficial similarity.

In the two prior U.S. patents, the two epoxy layers on opposite sides of the metal film-plus-substrate combination are so chosen as to produce balancing bending effects, acting equally but in opposite directions upon the metal film-plus-substrate sandwiched between the epoxy layers. Such balancing counteracts the tendency toward bending or warping of the substrate, which would arise due to temperature and/or humidity changes, if only one of these prior art epoxy coatings had been used.

In accordance with the present invention, the concept of balancing the bending by means of two epoxy layers of essentially the same thickness is intentionally not used.

In the present invention, the epoxy layer 22 covering the metal film 11 is of the same order of thickness as in the two prior U.S. patents, and serves essentially the same purpose as in these prior patents, namely to protect the metal film.

On the other hand, the second epoxy layer of the present invention, namely portion 14 of the composite substrate (see FIG. 1), is many times thicker than the similarly positioned epoxy layer which had been used in the two prior U.S. patents to balance out the bending tendency of the first-mentioned epoxy layer. In fact, in the present invention, the ceramic substrate will itself be subject to substantial bending due to layer 14 when the temperature changes.

In a typical embodiment of the present invention, this epoxy portion 14 of the composite substrate will have a thickness which is of the same order of magnitude as the ceramic portion 13 of the composite substrate. In a practical case, this ceramic portion may have a thickness of approximately 20 mils, in which case the thickness of the epoxy portion 14 would also be approximately 20 mils. This contrasts strikingly with the thickness of the similarly positioned epoxy coating in the two prior U.S. patents, which was of the order of 1 mil, as was the epoxy coating on the metal film itself, which remains essentially the same in the present invention.

The reason for this difference is, of course, that different objectives are achieved in the two situations, namely, in the two prior U.S. patents, on the one hand, and in the present invention, on the other hand.

In the present invention, it is the specific purpose of this much thicker epoxy portion 14 of the composite substrate to impart to surface 13*a* of this composite substrate a non-linear thermal expansion. This in turn makes it possible to approximately match in shape, but with opposite polarity, the resistance versus temperature characteristic of the metal film itself, which is also non-linear. In the prior patents, the surface corresponding to surface 13*a* (namely the interface between substrate and film) was subjected to linear expansion with temperature, while in the present invention this surface 13*a* is subject to a non-linear expansion with temperature; the shape and degree of non-linearity depend on the non-linear resistance versus temperature curve of the metal film. Nothing resembling this concept is disclosed in the two prior U.S. patents here under consideration.

Various techniques may be used to manufacture precision resistors according to the present invention.

One such technique involves starting with a plate of ceramic material of the thickness desired for the ceramic portion 13 of the composite substrate, e.g., 20 mils, but with a surface area much larger than required for a single typical resistor chip 10. Practical ceramic substrate thicknesses will range from 5 mils to a ¼" thickness. Most used will be 20 mils to 40 mils. An epoxy coating of one-half millimeter (20 mils) thickness, for example, is applied to one surface of this ceramic plate. This epoxy coating may be applied with a spatula, or by spinning, or by casting, or by cementing a sheet of epoxy. This epoxy coating is destined to be the epoxy portion 14 of the composite substrate. A specific epoxy resin material which may be used is that which is sold in commerce, under the name "Photolastic PL 1".

A metal film is also photo-etched in the desired serpentine resistive path pattern and then cemented to the side of the ceramic plate opposite to that which has previously been coated with the epoxy. Alternatively, the metal film may be first cemented to the ceramic and then photo-etched into the desired pattern. Alternatively, the epoxy coating may be applied after the film (photo-etched or not yet photo-etched) has been cemented to the surface of the ceramic.

This structure of a ceramic plate with a thick coating of epoxy on one side, and the photo-etched metal film pattern on the other, is then diced into individual resistor chips with a laser or a diamond saw or any other appropriate technique for dicing, so as to obtain the individual resistor chips. Of course, a chip may contain many interconnected or individual resistors.

Also, after photoetching, the metal film may be coated with the thin epoxy layer 22 of FIG. 1 for protection during handling and resistance tolerancing and for better performance in use.

Thereafter, if necessary, the chips 10 are individually adjusted (fine tuned) to the proper temperature coefficient of resistance characteristics by appropriately modifying the thickness of the thick epoxy coating on the ceramic portion of the composite substrate.

Then, leads may be attached, e.g., lead 16, 17 in FIG. 1, or alternatively such leads can be attached prior to fine tuning of temperature characteristic. Leads 16 and 17 could be two separate pieces or could be of one piece (monolithic).

Adjustment of the resistance of the resistors within its desired tolerance can be performed in conventional manner, before, during, or after temperature characteristic adjustment.

Finally, the structure is placed into a hermetically sealed can, e.g. can 18 in FIG. 1, with proper protection against mechanical interference such as the layer 21 of silicone rubber or other cushion. Thus, when high temperature conditions occur, the chip can expand or contract without being subject to external stress; it also provides protection against shocks and vibrations. Epoxy 20 is placed around cushion 21. If desired, oil, air or inert gas may be used around the cushion or instead of the cushion.

An alternative procedure involves first producing the essentially completed chips, lacking only the epoxy portion 14 of the composite substrate. These chips are then individually coated with a thick layer of epoxy by depositing a given thickness of that material in the position of epoxy portion 14 relative to the ceramic. The temperature coefficient of resistance (T.C.) of the resulting structure is measured and the thickness of this epoxy coating adjusted accordingly, if necessary.

In either case, i.e. whether the epoxy layer is applied to the large ceramic plate or to individual ceramic chips, the adjustment in epoxy thickness is made by scraping off a sufficient portion of the epoxy if it is initially too thick, or by adding additional comparatively thin layers of epoxy to build up the total thickness if it is determined by measurement to be initially too thin.

The adjustment of layer 14 is needed only for very fine tuning of temperature coefficient of resistance because, due to non-homogeneity of the film and manufacturing procedures, not all chips will show the same T.C. Hence, if initially the chip will not show the desired T.C., adjustment of the thickness of layer 14 will bring the T.C. to the desired value.

Other embodiments of the present invention are also within its scope.

One such other embodiment is diagrammatically illustrated in FIG. 3, to which reference may now be made. This Figure shows in cross-section a fragment of a chip 30 embodying the present invention. This chip includes a ceramic portion 31, to one side of which there is cemented a metal film 32 by cement layer 33. On the free surface of metal film 32, there is an epoxy protective layer 34. On the opposite side of the ceramic portion 31 from that to which the metal film 32 is cemented, there is a thick epoxy portion 35 of the same order of magnitude of thickness as the thickness of ceramic portion 31. To this extent, the chip construction of FIG. 3 is similar to that of chip 10 in FIG. 1. However, there is also a difference. This difference consists of the presence in FIG. 3 of a metal sheet 36 between the ceramic portion 31 and the epoxy portion 35 of the composite substrate. This metal sheet 36 is provided in order to enable further control of the temperature characteristics of the chip.

As previously explained, the composite substrate of ceramic and epoxy portions provides a non-linear function of thermal expansion. This composite function of thermal expansion can be considered as made up of two contributing components. One is a substantially linear component, the other is a non-linear component attributable to the epoxy. It is possible that the linear component may not be perfectly suitable for proper compensation. Assume, for example, that the linear component is equal to 6 ppm/°C., whereas a value of 8 ppm/°C. would be preferred for compensating the particular metal film 32. In that case, the presence of the metal sheet 36, with appropriate thickness and suitable coefficient of thermal expansion and modulus of elasticity, is able to impart to the resulting composite structure of ceramic and metal a substantially linear coefficient of thermal expansion of the desired, 8 ppm/°C. value at the surface 31*a* of ceramic portion 31 facing the resistive film 32. With this linear component now provided at the desired value, the epoxy portion 35 of the composite substrate (epoxy portion 35 plus ceramic portion 31) can again perform its role, in accordance with the invention. This role is to impart to the composite substrate the appropriate degree of non-linearity, which compensates for the non-linear resistance versus temperature characteristic of the resistive metal film itself.

Please note that whenever we refer to the thermal expansion of the composite substrate, we refer to the thermal expansion of that surface of the substrate which faces the metal film (e.g. 13*a* in FIG. 1 and 31*a* in FIG. 3). This is because the substrate is subject to bending so that the surface in question may expand positively, while other identifiable surfaces of the composite substrate expand differently.

It has also been found that the positional sequence of ceramic 31, metal 36 and epoxy 35 shown in FIG. 3 may be changed, so that the ceramic and epoxy 31 and 35 are immediately adjacent to each other, as was the case in FIG. 1, whereas the metal sheet 36 is placed on the outermost surface of the epoxy portion 35, namely on that surface which faces away from the ceramic portion 31. Instead of metal 36, another rigid material can be used, e.g. glass or ceramic of different coefficient of thermal expansion.

Moreover, a composite substrate which utilizes not only the ceramic and epoxy portions such as shown at 13 and 14 in FIG. 1, but also a metal component, leads itself to use in fine tuning the temperature coefficient of resistance of the chip.

Structures which embody this feature of the present invention are diagrammatically illustrated in FIGS. 4*a*, 4*b* and 4*c*, to which reference may now be made.

In each of these Figures there is diagrammatically illustrated a perspective view of a chip embodying the invention. The resistive metal film is designated by the reference numeral 40 in each of these Figures. The ceramic component of the substrate is designated by the same reference numeral 41 in all three of FIGS. 4*a* through 4*c*. Next to each ceramic portion 41, there is a metal structure. In FIG. 4*a* this metal structure takes the form of spaced parallel ribs 42. In FIG. 4*b* it takes the form of a grid of metal ribs, the intersecting ones of which are respectively designated by reference numerals 43 and 44. Finally, in FIG. 4*c* the metal structure takes the form of a plate 45 provided with a pattern of perforations 46.

In each instance the metal ribs or perforated plate are cemented to the ceramic.

In each of these embodiments, the interstices between the metal portions are filled with epoxy, which constitutes the epoxy portion of the composite substrate embodying the invention or the metal structure could be bonded on top of epoxy layer 35. In FIG. 4*a* these epoxy portions are in the form of strips 47. In FIG. 4*b* they are in the form of rectangles 48 and in FIG. 4*c* they are in the form of round portions 49 filling holes 46. The metal structure can also be bonded on top of the epoxy layer.

In each instance, adjustment of the chip resistance characteristics becomes possible with the structure illustrated by operating upon the metal portions.

For example, in FIGS. 4*a* and 4*b*, the coefficient of thermal expansion of the composite substrate (at the surface facing the metal film) can be adjusted in steps by cutting through various portions of the metal strips 42 in FIG. 4*a* and of grid 43, 44 in FIG. 4*b*. Likewise, in FIG. 4*c*, cuts in the metal 45 can be made to join holes 46 with the corresponding effect. In any of these instances, by cutting the metal there is produced a change in the linear component of thermal expansion of the composite substrate (at the surface facing the metal film). This, in effect, pivots about the origin the type of curve which is illustrated in FIG. 2*a* of the drawings.

Of course, other structures can be used for producing the same effect. By altering the metal sheet 36 geometry or even the ceramic substrate geometry, the linear component of the thermal expansion will change at the surface 31*a*; by altering the epoxy geometry the non-linear component of thermal expansion will change at surface 31*a*. The combination of altering these geometries provides fine tuning of the T.C.

Also, precision resistors of the general type under consideration are known in which the connecting leads to the resistive metal film are made of monolithic metal straps which bend about one edge of the chip and then pass along the side of the chip opposite that on which the resistive metal film is positioned. Such resistors are disclosed, for example, in the U.S. patent of Leon Resnicow, No. 4,138,656, also assigned to the assignee of the present invention. In such a construction, the metal leads may be firmly attached to the epoxy portion of the composite substrate embodying the present invention. Adjustment of the temperature characteristics may then be carried out by varying the thickness of the epoxy portion, the adjoining monolithic connecting leads, or both, or by cutting slots partially into the leads.

Alternatively, monolithic leads as disclosed in this above-identified U.S. Pat. No. 4,138,656 may be sandwiched into the thick epoxy portion of the composite substrate, or between that epoxy portion and the ceramic portion.

Tests of precision resistors embodying the present invention have shown that a resistor can be produced which functions satisfactorily in the range of temperatures normally required for military applications, which is that of −55° C. to +175° C. Wider temperature ranges (e.g. −100° C. to +250° C.) have also been covered with substantial improvement. Moreover, the reproducibility of results was excellent. Repeated cycling from cold to hot and back again caused only small modification of the resistance characteristics, despite the fact that the epoxy typically shows some amount of creep. Such small changes are negligible in practical usage. Testing under conditions of power and temperature has also shown that, with appropriate choice of materials, the resistor remains operational for many thousands of hours.

Even greater stability can be obtained by subjecting the epoxy portion of the composite substrate, after application to the chip, to a curing operation at temperatures which exceed those encountered during usage, preferably at least about 10° C. above the resistor operating range. This has the tendency to reduce the occurrence of dimensional changes in this epoxy portion with time and temperature. After being subjected to such a curing operation, the finished resistor will exhibit still greater stability.

The rigid portion of the composite substrate can also be a metal, provided it is insulated electrically from the resistive film and the leads.

The case 18 may be non metallic; e.g. ceramic or plastic. However, a plastic case (or molding) is not recommended if hermeticity is desired. Molding also can be used to protect the chip covered with a soft cushion.

I claim:

1. The method of manufacturing a resistor which includes a metal film constituting the resistive material, and a substrate to which the film is cemented, the method including the steps of forming the substrate as a composite of at least two generally parallel portions, one portion being substantially rigid and the other being a plastic, firmly cementing the resistive metal film to the surface of the rigid portion facing away from the plastic portion, providing the plastic portion with a thickness which is of the same order of magnitude as that of the rigid portion, subjecting the plastic portion to a curing operation at a temperature above the resistor operating range, and adjusting the thickness of the plastic portion to fine tune the temperature coefficient of the resistor.

2. The method of claim 1 and providing a metal portion adjacent to the rigid portion, and selectively cutting through the metal portion to fine tune the temperature coefficent of the resistor.

3. The method of claim 1 wherein the curing temperature is at least about 10° C. above the resistor operating range.

4. The method of manufacturing a chip for use in a precision resistor, which chip includes a bulk metal film constituting the resistive material, and a substrate to which the film is cemented, the method including the steps of forming the substrate as a composite of at least two generally parallel portions, one portion being substantially rigid and the other being a plastic, firmly cementing the resistive metal film to the surface of the rigid portion facing away from the plastic portion, providing the plastic portion with a thickness which is that of the rigid portion, subjecting the plastic portion to a curing operation at a temperature above the resistor operating range, and adjusting the thickness of the plastic portion to fine tune the temperature coefficient of the resistor.

5. The method of claim 4 and providing a metal portion adjacent to the rigid portion, and selectively cutting through the metal portion to fine tune the temperature coefficient of the resistor.

6. The method of claim 1 wherein the resistive metal film is cemented to the rigid portion before forming the composite.

7. The method of claim 1 wherein the resistive metal film is cemented to the rigid portion after forming the composite.

8. The method of claim 5 wherein the metal portion is provided in a configuration having interstices, and the plastic portion fills these interstices.

9. The method of claim 1 wherein the plastic is epoxy.

10. The method of claim 4 wherein the plastic is epoxy.

* * * * *